United States Patent [19]

Tokuno

[11] 4,249,847

[45] Feb. 10, 1981

[54] APPARATUS FOR TRANSPORTING BOARDS

[75] Inventor: Masateru Tokuno, Nishinomiya, Japan

[73] Assignee: Rengo Co., Ltd., Osaka, Japan

[21] Appl. No.: 950,681

[22] Filed: Oct. 12, 1978

[30] Foreign Application Priority Data

Oct. 24, 1977 [JP] Japan ..... 52-127724
Aug. 25, 1978 [JP] Japan ..... 53-104294

[51] Int. Cl.[3] ..... B65G 57/28

[52] U.S. Cl. ..... 414/330; 198/407; 414/38; 414/113; 414/114

[58] Field of Search ..... 414/38, 106, 107, 112–114, 414/117–118, 123–124, 330; 198/407, 412, 413; 271/3.1, 150, 151, 126

[56] References Cited

U.S. PATENT DOCUMENTS

| | | | |
|---|---|---|---|
| 2,716,500 | 8/1955 | Criger | 414/112 X |
| 3,521,763 | 7/1970 | Heide | 414/118 |
| 3,870,167 | 3/1975 | Werner | 414/114 |
| 3,884,345 | 5/1975 | Tokuno | 414/38 X |
| 3,908,836 | 9/1975 | Ikeda | 414/114 X |
| 3,924,758 | 12/1975 | Gram | 414/106 |
| 3,974,921 | 8/1976 | Tokuno | 414/754 X |
| 4,049,259 | 9/1977 | Ventz | 414/112 X |
| 4,103,786 | 8/1978 | Tokuno | 414/330 X |
| 4,119,219 | 10/1978 | Marschke | 414/114 |

*Primary Examiner*—Stephen G. Kunin
*Assistant Examiner*—Terrance L. Siemens
*Attorney, Agent, or Firm*—Norris & Bateman

[57] ABSTRACT

An apparatus for transporting boards comprising: a first conveyor adapted to transport a large number of boards in an upright position: a tripping device adapted to pivot every several or tens of the boards transported by the first conveyor to the delivery end thereof to lay the boards with the front faces upward and the bottom edges forward, and to transfer them to the feed end of a second conveyor; the second conveyor adapted to transport the laid boards to a subsequent process; and an aligning device adapted to align the front edges of the laid boards being transported by the second conveyor.

15 Claims, 12 Drawing Figures

APPARATUS FOR TRANSPORTING BOARDS

The present invention relates to an apparatus for transporting a large number of boards such as pieces of corrugated board and, more particularly, relates to an apparatus for pivoting the boards in an upright position to lay the boards with the front faces upward and the bottom edges forward, and thereafter aligning the front edges of the laid boards and transporting them to the subsequent process.

The present inventor and others have already developed an apparatus for successively pivoting a large number of boards, which are in an upright position, individually or in small bundles to lay the boards with the front faces downward and the bottom edges backward, and feeding them into a hopper of a board-treating machine such as a printing machine. However it has relied on a manual operation to successively pivot the boards to lay them with the front faces thereof upward and the bottom edges forward, and thus such operation for transporting the boards has been quite inefficient.

An object of the present invention is to provide an apparatus, in which a large number of boards transported in an upright position are pivoted and laid with the front faces thereof upward and the bottom edges forward without relying on the manual operation, and thereafter the front edges thereof are aligned and a large number of boards are transported to a subsequent process. Other objects, features and advantages of the present invention will become apparent from the following description of preferred embodiments thereof taken in conjunction with the appended drawings, wherein FIG. 1 is a side view showing an embodiment of the apparatus according to the present invention;

Figure 10:
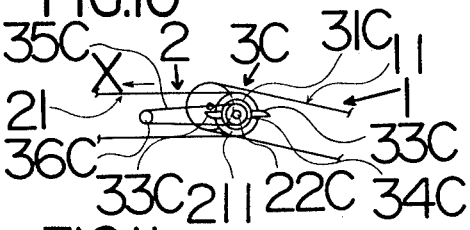
FIG. 10 is a schematic side view illustrating a further embodiment of the tripping device.
Figure 11:
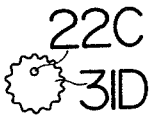
Figure 12:
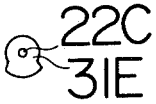

FIGS. 11 and 12 are side views illustrating still further embodiments of the rotary member in the tripping device shown in FIG. 10; In an embodiment shown in FIGS. 1–8, an apparatus according to the present invention comprises a first conveyor 1, a second conveyor 2, transfer means in the form of a tripping device 3 and an aligning device 4.

The first conveyor 1 is provided with parallel spaced endless chain conveyors 11, with slats thereon, running in the direction X of the transportation of boards. These chain conveyors 11 are connected with each other by transverse members, not illustrated herein, except at a delivery end 111. A sprocket 112 at the feed end of each chain conveyor 11 is fixed to a common shaft 12 which is driven by a motor 14 through a chain transmission 13. The first conveyor 1 is further provided with forks 15, which are arranged for respective chain conveyors 11.

Each fork 15 is composed of a rod-like member extending substantially vertically and upwardly from the tranportation surface of each chain conveyor 11. The lower end of each fork 15 is connected to a pair of endless chains 113 so as to be movable together with the chains 113. The lower end of each fork 15 is movable engaged with a pair of supporting rails, not illustrated herein, through idle rollers 151 so that each fork 15 can keep a position thereof substantially vertical with respect to the transportation surface of the first conveyor 1.

The first conveyor 1 is further provided with a turning means 16 which receives a pile 60 of contiguous boards 6 and then turns. The means 16 comprises a shaft 161 which rotatably supports the chain conveyors 11 between a pair of side frames 10; A carrier table 162 which has a large number of balls 1621, extends substantially vertically with respect to the transportation surface of the conveyor 1 from between the feed ends of the conveyors 11 and is adapted to turn together with the conveyors 11. A pair of hydraulic or pneumatic piston cylinder assemblies 163 turn the conveyors 11 and the carrier table 162 from the position A, shown by the alternate long and two short dashes line in FIG. 1, for receiving the pile 60 of the boards 6 to the position B, shown by the solid line in FIG. 1, wherein the boards 6 are placed in an upright position. In the position A, the carrier table 162 is substantially horizontal and the forks 15 are entered into spaces formed at the carrier table 162. In the position B, the conveyors 11 are slightly inclined upwardly from the feed end 110 thereof toward the delivery end 111.

The second conveyor 2 is provided with parallel spaced endless belt conveyors 21 running in the direction X of the transportation of the boards. The belt conveyors 21 are disposed between a pair of side frames 100. A pulley 211 at the feed end of each belt conveyor 21 is securely fitted on a common shaft 22 which is driven by a motor 24 through a chain transmission 23.

The second conveyor 2 is adapted to be pivoted around the shaft 22 by means of a piston cylinder assembly 20, and thereby the delivery end 213 thereof is raised and lowered.

The tripping device 3 is provided with parallel spaced transfer conveyors 31 (endless belt conveyors) running in the direction X of the transportation of the boards. A pair of frames 311 of each belt conveyor 31 are L-shaped and the flexed parts 3111 thereof are rotatably fitted on the shaft 22 at the feed end of the second conveyor 2. The end 3112 of the portion of each frame 311 extending toward the first conveyor 1 rotatably supports a pulley 312 at the feed end of each transfer conveyor 31. When the first conveyor 1 is in the position B, wherein the boards 6 are in an upright position, the feed end 30 of each conveyor 31 is in the space formed at the delivery end 111 of the first conveyor 1. The ends 3113 of the portions of the frames 311 extending downwardly are connected with each other by a common member 313.

A pulley 314 at the delivery end of each belt conveyor 31 is securely fitted on the shaft 22 at the feed end of the second conveyor 2, and the delivery end 300 of each conveyor 31 is disposed to be in the space formed at the feed end 212 of the second conveyor 2.

The tripping device 3 is further provided with a hydraulic or pneumatic piston cylinder assembly 32 which acts upon the connecting member 313 for pivoting the conveyor frames 311 around the shaft 22 so that the transportation surface of each belt conveyor 31 at the feed end 30 may be raised above and lowered below the transportation surface of the first conveyor 1.

An aligning device 4 provides gates 41 hanging downwardly above the conveyor 2 and aligned transversely with respect to the direction X of the transportation of the boards with space between each other, and a gate pivoting device 42 for pivoting the gates 41.

One edge of each gate 41 is securely attached to a rotary shaft 402 rotatably supported by supporting rods 401 which are securely attached to a turned U-shaped pipe frame 40 attached to a pair of the side frames 100 of the second conveyor 2 and standing thereon. Another edge of each gate 41 hangs downwardly into the space between the belt conveyors 21 of the second conveyor 2. The gate pivoting device 42 comprises a pneumatic or hydraulic piston cylinder assembly 421, a cylinder 4211 of which is rotatably connected to frames 403 attached to the pipe frame 40, and an arm 43. One end of arm 43 is securely attached to the rotary shaft 402 and other end of which is rotatably fitted to a piston rod 4212.

The present invention further comprises limit switch means 50 disposed at the carrier table 162 for actuating the turning means 16. The means 16 is turned counterclockwise after a predetermined time interval when the boards 6 touch said limit switch means 50, and the conveyors 11 are started after a predetermined time interval set by a timer, not illustrated herein, when the means 16 is turned. Limit switch means 51 disposed at the delivery end 111 of the first conveyor 1 for stopping the conveyors 11 when the boards 6 pushed and transported by the forks 15 touch said limit switch means 51. The limit switch means 51 at the same time starts the piston cylinder assembly 32 of the tripping device 3 and keeps the feed ends 30 of the belt conveyors 31 of the tripping device 3 in a raised position for a predetermined time interval set by a timer, not illustrated herein, and then lowers said feed ends 30. Limit switch means 52 disposed under the tripping device 3 to start the conveyors 11 when the lowered feed ends 30 touch said limit switch means 52. Photo-tube means 53 is installed below the transportation surface of the second conveyor 2. The installation position of photo-tube means 53 is adjustable. The piston cylinder assembly 32 of the tripping device 3 is kept stopped while the photo-tube means 53 is shaded by the transported boards 6, and driven while said photo-tube means 53 is not shaded by the boards 6. Limit switch means 54 is disposed at a portion of the transportation surface of the second conveyor 2 adjacent to the aligning device 4. Switch means 54 actuates the piston cylinder assembly 421 when the transported boards 6 touch said limit switch means 54 and closes the gates 41 after a predetermined time interval set by a timer, not illustrated herein, and then closes the gates 41 after a predetermined time interval set by a timer, not illustrated herein, when the boards 6 pass by the limit switch means 54 and switch means 54 is reset. 55 is disposed at the delivery end 213 of the second conveyor 2. Switch means 55 suddenly stops the second conveyor 2, when the transported boards 6 touch said limit switch means 55 and phototube means 56 is shaded for a predetermined time interval. The photo-tube means 56 is disposed in a hopper 8 for suddenly stopping the second conveyor 2 in cooperation with the actuation of said limit switch means 55, when the supplied boards 6 fill the hopper and shade said photo-tube means 56, and then restarts said second conveyor 2 when said boards 6 are further transported and leave the position where they shade said photo-tube means 56. There is another limit switch means, not illustrated herein. This other limit switch mean turns the turning means 16 from the position B to position A when the forks 15 are fully advanced and touch this other limit switch means and the boards 6 remaining on the first conveyor 1 are transferred to the second conveyor 2 by the tripping device 3 and the photo-tube 53 becomes shaded by said boards 6.

Operation of the apparatus according to the present invention is described hereinafter.

Figure 1:
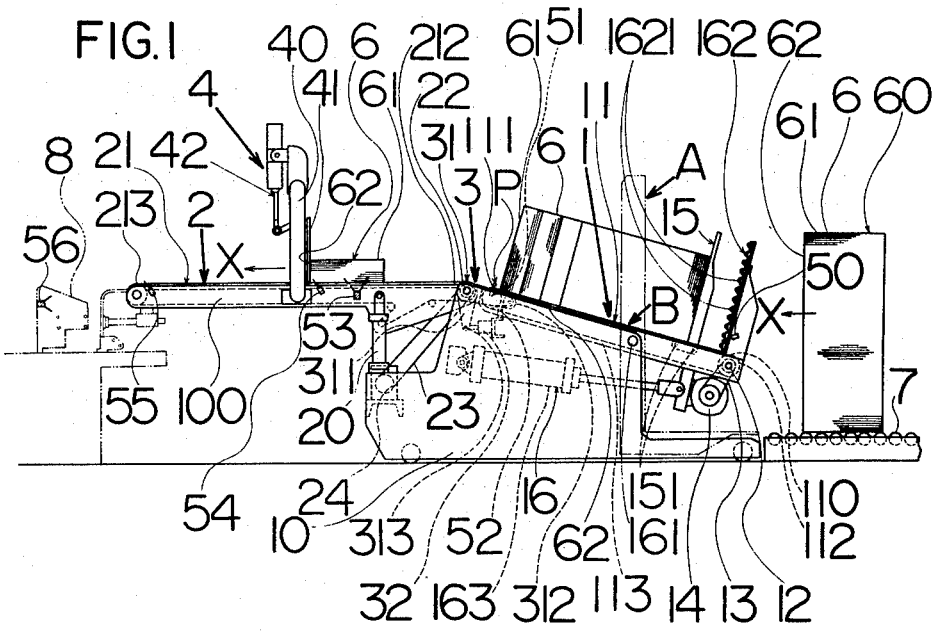
Figure 2:
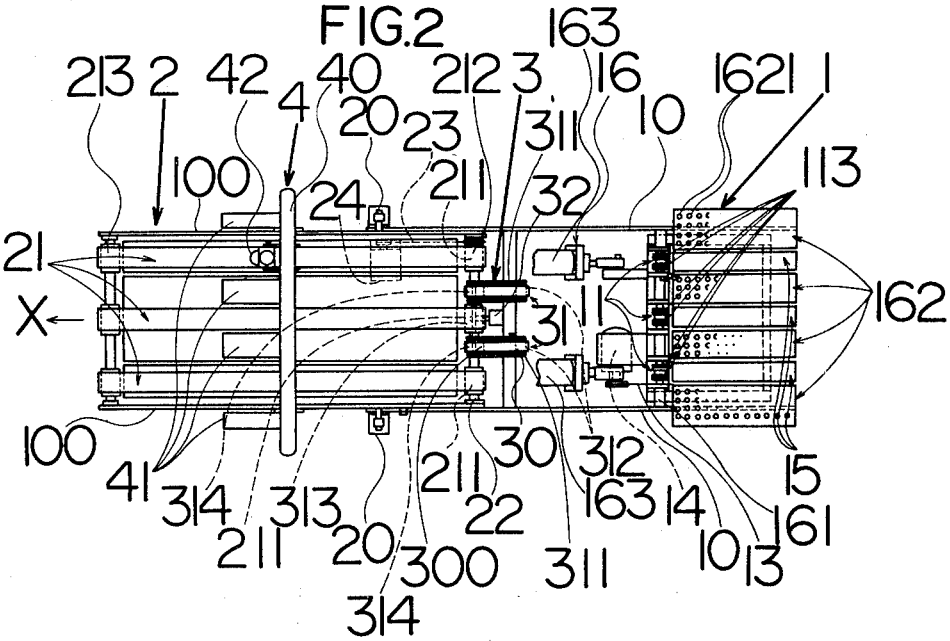
FIG. 2 is a plan view, with certain parts removed for clarity, of the apparatus according to the present invention shown in FIG. 1, in which a first conveyor is in a position for receiving a pile of boards.
Figure 3:
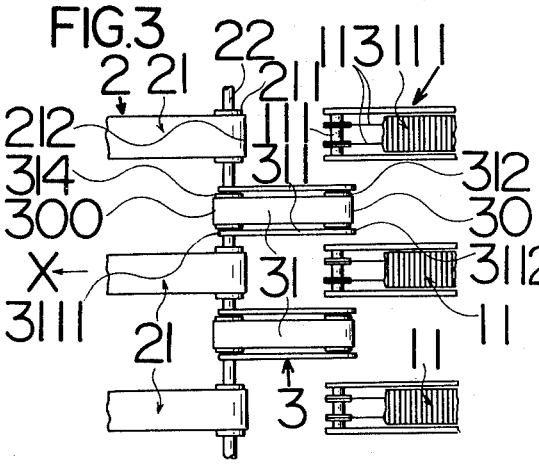
FIGS. 3 and 4 are respectively an enlarged plan view and an enlarged side view of a tripping device in the apparatus according to the present invention shown in FIG. 1.
Figure 5:
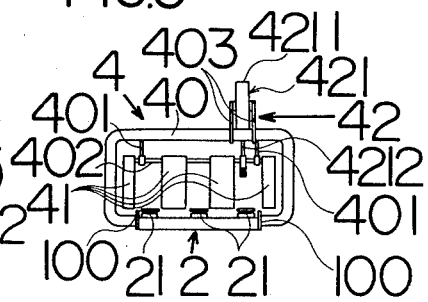
FIG. 5 is an enlarged front view of an aligning device in the apparatus according to the present invention shown in FIG. 1.
Figure 6:
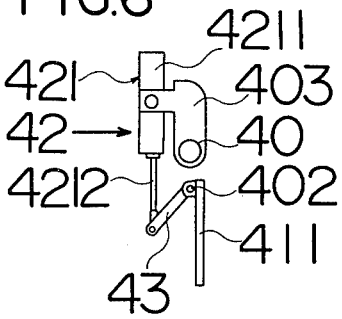
FIG. 6 is an explanatory side view of a gate pivoting device of the aligning device.
Figure 4:
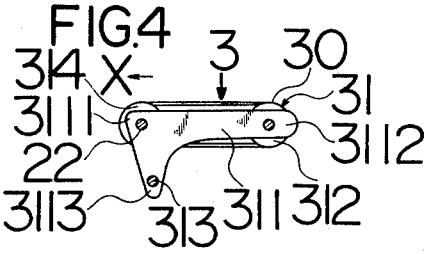

First, the motor 14 of the first conveyor 1 is reversed and thereby the chain conveyors 11 are reversed so that the forks 15 are entered into spaces at the carrier table 162. The chain conveyors 11 and the carrier table 162 are turned clockwise by the turning means 16 to board loading postion A. When the pile 60 in which the boards 6 are piled with their front faces 61 upward and bottom edges 62 forward in the direction X of the transportation of the boards, is transported by suitable supply conveyor 7 to the first conveyor 1 occupying the position A and the pile 60 is received by the carrier table 162 which is then in a horizontal position with the board in the same orientation. By the actuation of the limit switch means 50, the turning means 16 starts and thereby the chain conveyors 11 and the carrier tables 162 are turned counterclockwise into the position B, so that the boards 6 of the pile 60 are placed in an upright position on the chain conveyors 11 as shown in FIG. 1. The front face 61 of each board 6 now faces in said direction X and the bottom edge 62 of each board is positioned at the bottom of the turned pile.

Next, the motor 14 is driven in the normal direction and the turned pile of boards 6 is advanced toward the delivery end 111 of the first conveyor 1 by the forks 15 as shown in FIG. 1. When the boards 6 reach the point P at the delivery end 111 of the first conveyor 1, the limit switch 51 is actuated by the boards 6 and thereby the first conveyor 1 is stopped so as to suspend transportation of the boards and the piston cylinder assembly 32 of the tripping device 3 is actuated.

Figure 7:
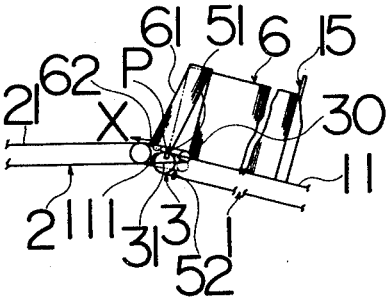
FIGS. 7 and 8 are explanatory views illustrating the boards transferring operation of the tripping device in the apparatus according to the present invention shown in FIG. 1.

The belt conveyors 31 of the tripping device 3 are driven by the motor 24. By the operation of the piston cylinder assembly 32, the transportation surfaces of the feed ends 30 of the conveyors 31 are raised above the transportation surface of the first conveyor 1. When the feed ends 30 of the conveyors 31 are raised above the transportation surface of the first conveyor 1, the bottom edges 62 of a bundle or group containing several or tens of the boards 6 which are in the forward portion of the boards 6 in an upright position, i.e., the edges 62 of the boards 6 positioned on the belt conveyors 31 of the tripping device 3, are lifted from the first conveyor 1 as shown in FIG. 7 and moved in the direction X by the belt conveyors 31.

Figure 8:
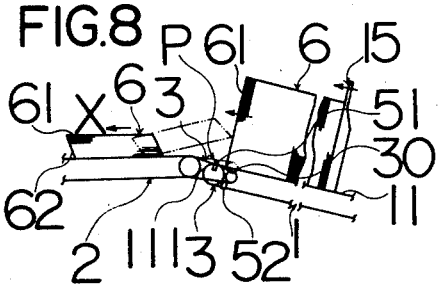

When the edges 62 of a bundle of the boards 6 are moved in the direction X, the bundle of boards 6 are pivoted 6 are pivoted so as to be laid flat on the conveyors 21 with the front faces 61 of each board upward and the bottom edges 62 forward in said direction X without relying on manual operation as shown in FIG. 8, and thereafter transferred to the second conveyor 2 which is driven by the motor 24.

When a bundle of the boards 6 are being pivoted and laid onto conveyor 2, each individual board slides forwardly from the following one. However, as a bundle of the boards 6 are transported on the second conveyor 2 and strikes the closed gates 41 of the aligning device 4, the board bundle is squared where the edges 62 of the bundle are aligned substantially in a vertical plane. Then the gates 41 are opened by the operation of the limit switch means 54 and the squared board bundle is supplied into the hopper 8 from the delivery end 213 of the second conveyor 2.

In case that the opening speed of the gates 41 is slow, the board bundle is supplied into the hopper with the aligned front face slightly inclined backwardly from the bottom edge toward the top edge.

The gates 41 are closed after the board bundle has passed through the same. When one operation of the tripping device 3 for transferring the boards 6 is completed, the feed ends 30 of the belt conveyors 31 are lowered and when the lowering is completed, the limit switch means 52 is actuated and the first conveyor 1 is restarted. When the remaining boards 6 on the first conveyor 1 reach the limit switch means 51, the piston cylinder assembly 32 of the tripping device 3 is restarted. However, when the board bundle laid flat by the last operation of the tripping device 3 is still remaining on the portion of the transportation surface of the second conveyor 2 adjacent to the gates 41, the photo-tube means 53 is shaded, and thereby the piston cylinder assembly 32 of the tripping device 3 is not restarted until the bundle clears. When the hopper 8 is filled with the boards 6, the second conveyor 2 and the tripping device 3 are stopped by the operations of the limit switch means 55 and the photo-tube means 56. When all of the boards 6 on the first conveyor 1 are transferred from the first conveyor 1, and the forks 15 fully advanced actuate the limit switch means, not illustrated herein, and further the photo-tube means 53 is shaded by the last board bundle, the first conveyor 1 is turned clockwise by the turning means 16 and the conveyors 11 and the carrier table 162 are brought back into the position A for receiving a pile 60 of the boards 6.

Figure 9:
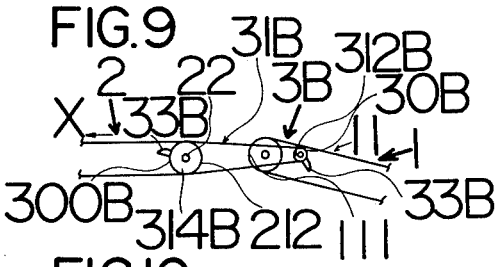
FIG. 9 is a schematic side view illustrating another embodiment of the tripping device.

In another embodiment of the present invention FIG. 9, a tripping device 3B providing parallel spaced conveyors 31B (endless belt conveyors) which have kickers 33B is employed instead of the tripping device 3. In the tripping device 3B, a pulley 314B at the delivery end of each belt conveyor 31B is rotatably fitted onto the shaft 22 at the feed end of the second conveyor 2, and a pulley 312B at the feed end of each belt conveyor 31B is driven by a driving means not illustrated herein. When the first conveyor 1 is in the position B for transporting the boards 6, the feed end 30B of each conveyor 31B is entered into the space formed at the delivery end 111 of the first conveyor 1, and the delivery end 300B of each conveyor 31B is disposed in the space formed at the feed end 212 of the second conveyor 2. Further, the endless transporting member of each conveyor 31B is provided with at least one kicker 33B.

Upon starting the transferring operation of the tripping device 3B, the kickers 33B of the conveyors 31B rotate counterclockwise, so that several or tens of the boards 6 in a bundle in an upright position on the first conveyor 1 are pivoted and laid with the bottom edges 62 thereof forward and the front faces 61 upward and transferred to the second conveyor 2 as in the embodiment described hereinbefore.

In a further embodiment of the present invention (FIG. 10), a tripping device 3C providing rotary members 31C which have kickers 33C and spaced transversely with respect to said direction X is employed as shown in FIG. 10 instead of the tripping device 3. In the device 3C, the rotary members 31C are disposed in the space formed between the chain conveyors 11 of the first conveyor 1 and also in the space formed at the feed end of the second conveyor 2 while rotatably supported by pulley shafts 22C which are provided correspondingly to the number of the belt conveyors 21. Sprockets 34C are attached to the rotary members 31C to rotate therewith and cooperate with sprockets 36C driven through chains 35C by a driving means not illustrated herein.

Upon starting the transferring operation of the tripping device 3C, by the kickers 33C of the rotary members 31C rotating counterclockwise, several or tens of boards 6 in an upright position on the first conveyor 1 are pivoted and laid in a flat bundle a with the bottom edges 62 forward and the front faces 61 upward, and then transferred to the second conveyor 2, as in the embodiments described hereinbefore.

In still further embodiment of the present invention, an eccentric rotary member 31D (see FIG. 11), preferably having regularly waved periphery, or a cam 31E (see FIG. 12) is employed instead of the rotary member 31C and the same effect is obtained.

The tripping devices 3B and 3C (31C, 31D and 31E) are provided with a driving means respectively. When the boards 6 transported by the first conveyor 1 reach the limit switch 51, the tripping device 3B or 3C is started moving and rotating to lift and displace the leading group of boards in the same way as in the embodiment of FIGS. 1 to 8.

What is claimed is:

1. In an apparatus for transporting boards, a first conveyor adapted to transport a large number of contiguous boards on edge in an upright position, said boards having front faces facing in the direction of their movement by said first conveyor and bottom edges resting on said first conveyor, means at the discharge end of said first conveyor for receiving bundles of boards from said first conveyor, and transfer means adjacent said discharge end of said first conveyor adapted to lift off said first conveyor and forwardly move the bottom edges of boards in a leading group of the boards being transported by said first conveyor whereby to lay said group of boards in a flat bundle at said receiving means with said front faces upward and said bottom edges forward in the direction of transport.

2. In the apparatus defined in claim 1, said receiving means being a second conveyor adapted to convey said bundle to a subsequent process.

3. In the apparatus defined in claim 1, said transfer means being such that successive groups of boards are transferred from said first conveyor to said receiving means where they are successively transported to a subsequent process.

4. In the apparatus defined in claim 3, means being provided for preventing successive groups from interferring overlap at said receiving means.

5. In the apparatus defined in claim 1, means being provided for aligning the front edges of the boards of the bundle on said receiving means.

6. In the apparatus defined in claim 1, said transfer means comprising transfer conveyor means having an infeed end in substantial overlap with said first conveyor, and means mounting said transfer conveyor means for movement between a position where said infeed end is disposed below the discharge end of said first conveyor and a position where said infeed end is disposed above the discharge end of said first conveyor.

7. In the apparatus defined in claim 6, said transfer conveyor means being pivoted for movement about an axis perpendicular to the direction of movement of said boards.

8. In the apparatus defined in claim 6, said first conveyor comprising a laterally spaced plurality of conveyor members, and said transfer conveyor means comprises a plurality of conveyor members adapted to extend into spaces between the conveyor members of said first conveyor.

9. In the apparatus in claim 1, said transfer means comprising a transfer conveyor in such arrangement that the feed end thereof is disposed in overlapping relationship with the discharge end of said first conveyor, and said transfer conveyor is provided with an endless transferring member having at least one kicker for engaging the boards.

10. In the apparatus defined in claim 1, said transfer means comprising at least one rotary member disposed in overlapping relationship with the discharge end of said first conveyor, said rotary member having at least one kicker for engaging the boards.

11. In the apparatus defined in claim 1, said transfer means comprising at least one eccentric rotary board engaging member disposed in overlapping relationship with the discharge end of said first conveyor.

12. In the apparatus defined in claim 1, said transfer means comprising a rotary board engaging cam disposed in overlapping relationship with the delivery end of said first conveyor.

13. In the apparatus defined in claim 1, said first conveyor comprising a plurality of laterally spaced conveyor members, said receiving means being a second conveyor comprising a plurality of laterally spaced conveyor members adapted for movement parallel to said first conveyor members, a power driven shaft extending perpendicular to the direction of transport of said boards and means on said shaft for driving said second conveyor members, said transfer means comprising at least one conveyor member mounted on a support and adapted for movement parallel to the other conveyor members, means pivoting said support on said shaft, means for adjusting said support to locate an end of the transfer conveyor member below or above the discharge ends of said first conveyor members, and means for driving said transfer conveyor from said shaft.

14. In the apparatus defined in claim 1, said first conveyor comprising a plurality of laterally spaced conveyor members, said receiving means being a second conveyor comprising a plurality of laterally spaced conveyor members adapted for movement parallel to said first conveyor members, a power driven shaft extending perpendicular to the direction of transport of said boards and means on said shaft for driving said second conveyor members, said transfer means comprising at least one conveyor member adapted for movement parallel to the other conveyor members and extending from a space between first conveyor members to a space between second conveyor members, means for driving said transfer conveyor from said shaft, and rotary kicker members for engaging the board disposed at the discharge end of said first conveyor and on said shaft.

15. In the apparatus defined in claim 1, said first conveyor comprising a plurality of laterally spaced conveyor members, said receiving means being a second conveyor comprising a plurality of laterally spaced conveyor members adapted for movement parallel to said first conveyor members, with ends of said first conveyor members extending into spaces between adjacent ends of said second conveyor members, a power driven shaft extending perpendicular to the direction of transport of said boards and means on said shaft for driving said second conveyor members, said transfer means comprising rotatable board engaging kicker means on said shaft.

* * * * *

UNITED STATES PATENT AND TRADEMARK OFFICE

CERTIFICATE OF CORRECTION

PATENT NO. : 4,249,847

DATED : February 10, 1981

INVENTOR(S) : Masateru Tokuno

It is certified that error appears in the above–identified patent and that said Letters Patent are hereby corrected as shown below:

Column 2, line 11, change "movable" to --movably--.

Column 3, line 65, before "55" insert --Limit switch means--.

Signed and Sealed this

First Day of December 1981

[SEAL]

Attest:

GERALD J. MOSSINGHOFF

Attesting Officer

Commissioner of Patents and Trademarks